US007631530B2

(12) United States Patent
Hamano et al.

(10) Patent No.: US 7,631,530 B2
(45) Date of Patent: Dec. 15, 2009

(54) ALUMINUM PIPE PRODUCTION METHOD

(75) Inventors: Hidemitsu Hamano, Oyama (JP); Takanori Kanayama, Oyama (JP); Masahiro Miyazaki, Oyama (JP)

(73) Assignee: Showa Denko K.K., Tokyo (JP)

( * ) Notice: Subject to any disclaimer, the term of this patent is extended or adjusted under 35 U.S.C. 154(b) by 14 days.

(21) Appl. No.: 11/718,928

(22) PCT Filed: Nov. 9, 2005

(86) PCT No.: PCT/JP2005/020993

§ 371 (c)(1),
(2), (4) Date: May 9, 2007

(87) PCT Pub. No.: WO2006/052002

PCT Pub. Date: May 18, 2006

(65) Prior Publication Data

US 2007/0277580 A1 Dec. 6, 2007

Related U.S. Application Data

(60) Provisional application No. 60/627,946, filed on Nov. 16, 2004.

(30) Foreign Application Priority Data

Nov. 9, 2004 (JP) ..... 2004-325213

(51) Int. Cl.
*B21B 27/06* (2006.01)
*B21C 35/00* (2006.01)

(52) U.S. Cl. ..... 72/236; 72/257

(58) Field of Classification Search ..... 72/236, 72/256, 257, 367.1, 368; 134/6, 8; 15/88, 15/88.1–88.3, 104.04
See application file for complete search history.

(56) References Cited

U.S. PATENT DOCUMENTS 1,924,522 A * 8/1933 Sparks ..... 72/72

FOREIGN PATENT DOCUMENTS

| | | |
|---|---|---|
| JP | 5 313394 | 11/1993 |
| JP | 7 319191 | 12/1995 |
| JP | 8 82939 | 3/1996 |
| JP | 9 319127 | 12/1997 |
| JP | 10-83089 | 3/1998 |
| JP | 2001-205178 | 7/2001 |
| JP | 2002-123024 | 4/2002 |
| JP | 2004 9227 | 1/2004 |

* cited by examiner

*Primary Examiner*—Dana Ross
*Assistant Examiner*—Teresa M Bonk
(74) *Attorney, Agent, or Firm*—Oblon, Spivak, McClelland, Maier & Neustadt, L.L.P.

(57) ABSTRACT

The invention is directed to a aluminum pipe production method comprising an extrusion step for obtaining an aluminum raw pipe (10) and a drawing step for executing a drawing process of the aluminum raw pipe (10). Before executing the drawing step a slug removing step for removing aluminum slugs (1) adhering to a surface of the aluminum raw pipe (10) is executed by rubbing off the aluminum slugs (1). This can provide an aluminum pipe production method capable of preventing generation of defect protrusions while improving the productivity.

24 Claims, 5 Drawing Sheets

ALUMINUM PIPE PRODUCTION METHOD

This application claims priority to Japanese Patent Application No. 2004-325213 filed on Nov. 9, 2004 and U.S. Provisional Application Ser. No. 60/627,946 filed on Nov. 16, 2004, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application Ser. No. 60/627,946 filed on Nov. 16, 2004, pursuant to 35 U.S.C. §111(b).

TECHNICAL FIELD

The present invention relates to a method for producing an aluminum pipe to be used as a photosensitive drum for copying machines or electrophotographic devices such as laser beam printers or facsimile devices, and its related technique.

In the specification and claims, the wording of "aluminum (Al)" is used to mean aluminum and its alloy.

BACKGROUND ART

The following description sets forth the inventor's knowledge of related art and problems therein and should not be construed as an admission of knowledge in the prior art.

As a photosensitive drum substrate for use in a photoelectrographic device, a substrate in which a photosensitive layer of, e.g., OPC (organic photoconductor) is formed on an external peripheral surface of a cylindrical aluminum pipe has been used. To attain excellent image quality, the photosensitive layer of the photosensitive drum is required to be thin and uniform in thickness with a high degree of accuracy, which in turn requires an aluminum pipe as the base material to have a surface high in smoothness.

As an aluminum pipe for such photosensitive drum substrate, an extruded aluminum pipe obtained by drawing an extruded aluminum raw pipe (hereinafter referred to as "ED pipe") has been popularly used.

Such ED pipe may sometimes have defect protrusions caused by aluminum slugs (Al slugs) which adhered to the surface of the pipe during the extrusion process. Therefore, there is a report that such ED pipe causes image defects due to the defect protrusions when used as a photosensitive drum substrate as it is.

In view of the problems, in cases where such ED pipe is used as a photosensitive drum substrate, to prevent generation of defect protrusions, the external peripheral surface is popularly subjected to cutting work to obtain a mirror finished surface to thereby enhance the surface smoothness.

However, surface modification processing such as cutting work is insufficient, resulting in deteriorated productivity and increased production cost.

Under circumstances, there are many proposals regarding technique for employing a non-machined ED pipe as a photosensitive drum substrate.

For example, Japanese Unexamined Laid-open Patent Publication No. H08-82939 (hereinafter referred to as "Patent Document 1") proposes a method for producing an aluminum pipe in which a surface of an ED pipe is wiped (polished) with a clean cloth, etc., after the drawing processing.

Japanese Unexamined Laid-open Patent Publication No. 2004-9227 (hereinafter referred to as "Patent Document 2") proposes a method for producing an aluminum pipe in which a surface of an ED pipe is polished with polishing agent after the drawing processing.

Furthermore, Japanese Unexamined Laid-open Patent Publication No. H05-313394 (hereinafter referred to as "Patent Document 3") proposes a method for producing an aluminum pipe in which a certain thickness of an external peripheral surface of an extruded aluminum raw pipe is removed by cutting, etching, blasting, polishing, etc., before the drawing processing.

In the method for producing an aluminum pipe as disclosed by Patent Documents 1 and 2 in which a surface of an aluminum pipe is subjected to polishing or the like to improve the surface smoothness after the drawing processing, this method performs a surface modification like the method employing a cutting work. Therefore, the method is not only inefficient and but also hard to fundamentally solve problems such as deteriorated productivity and increased producing cost.

On the other hand, in the method for producing an aluminum pipe as disclosed by Patent Document 3, since a surface of an aluminum pipe is removed evenly before the drawing processing, there is a possibility that the removed slugs (aluminum slugs) re-adheres to the surface of the aluminum raw pipe to cause defect protrusions due to the removed slugs after the drawing processing, resulting in image defects by the defect protrusions. Thus, it was difficult to attain high quality. Furthermore, in this method, since the surface of the aluminum raw pipe is removed by a certain thickness, the surface removing causes a decreased diameter. As a result, it becomes difficult to control the pipe diameter, which in turn may cause deterioration of the quality due to the deteriorated dimensional accuracy.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

Other objects and advantages of the present invention will be apparent from the following preferred embodiments.

DISCLOSURE OF INVENTION

The preferred embodiments of the present invention have been developed in view of the above-mentioned and/or other problems in the related art. The preferred embodiments of the present invention can significantly improve upon existing methods and/or apparatuses.

The present invention was made to solve the aforementioned problems of conventional technique, and aims to provide a method for producing an aluminum pipe capable of assuredly preventing defects such as generation of defect protrusions to improve the quality while attaining improved productivity and reduced cost.

In order to solve the aforementioned problems of the conventional technique, the present inventors conducted detail investigation about the structure of the fault protrusion, mechanism of generation of the fault protrusion, etc., in producing a photosensitive drum using an ED pipe. The investigation revealed the following facts. As shown in FIG. 11A, in many cases, aluminum slugs 1 generated during the extrusion process of the aluminum raw pipe 10 adhere to the surface of the aluminum raw pipe 10. If this aluminum raw pipe 10 with such aluminum slugs 1 is subjected to a drawing process to form an aluminum tube 11, the aluminum slug 1 is also drawn as shown in FIG. 11B. This extended piece 2 of the aluminum slug 1 is very thin, e.g., 2 μm or less in thickness and adheres to the surface of the aluminum pipe 11 in a laminated manner. If this adhered aluminum slug extended piece 2 is raised by external influences such as ultrasonic waves as shown in FIG. 11C, the raised piece constitutes a harmful defect protrusion 3. For example, such defect protrusion 3 causes a leak at the time of forming a photosensitive layer, resulting in defects such as image defects.

The inventors' continuous detail investigation also revealed the following facts. The aluminum slug extended piece 2 drawn by a drawing process has a lepidic shape similar to an oval shape or an elliptical shape. Among these extended pieces 2, even if a minute extended piece with a small area is raised by external influences, it merely becomes a harmless minute protrusion, causing no image defect. However, if an extended piece with a large area is raised, it becomes a harmful defect protrusion 3, causing defects such as image defects.

Based on the above investigation results, the present inventors have repeatedly conducted careful studies and experiments, and found a structure capable of attaining the aforementioned objects to complete the invention.

To attain the aforementioned objects, the present invention has the following structures.

[1] An aluminum pipe production method comprising an extrusion step for obtaining an aluminum raw pipe and a drawing step for executing a drawing process of the aluminum raw pipe, characterized in that before executing the drawing step, a slug removing step for removing aluminum slugs adhering to a surface of the aluminum raw pipe by rubbing off the aluminum slugs is executed.

[2] The aluminum pipe production method as recited in the aforementioned Item 1, wherein the aluminum slugs are removed by rubbing a soft rubbing member against the surface of the aluminum raw pipe.

[3] The aluminum pipe production method as recited in the aforementioned Item 2, wherein the rubbing member comprises at least one element selected from the group consisting of a brush, a sponge, an ultra fine fiber fabric, and an ultra fine fiber non-woven fabric.

[4] The aluminum pipe production method as recited in the aforementioned Item 2 or 3, wherein the rubbing member is a brush with a bristle diameter of 50 to 1 μm.

[5] The aluminum pipe production method as recited in the aforementioned Item 4, wherein a bristle length of the brush is adjusted to 20 to 100 mm.

[6] The aluminum pipe production method as recited in the aforementioned Item 4 or 5, further comprising a step for preparing a rubbing roller in which the rubbing member is wound around a central axle, wherein an external surface of the rubbing roller rubs the surface of the aluminum raw pipe while rotating the rubbing roller.

[7] The aluminum pipe production method as recited in the aforementioned Item 6, wherein the rubbing roller is set to 50 to 240 mm in roller external diameter, and wherein a rotation speed of the rubbing roller is set to 1,000 to 3,000 rpm.

[8] The aluminum pipe production method as recited in the aforementioned Item 6 or 7, wherein at the time of removing the aluminum slugs with the rubbing roller, the rotating rubbing roller is moved relative to the aluminum raw pipe along an external periphery of the aluminum raw tube while rubbing the aluminum raw pipe with the rotating rubbing roller.

[9] The aluminum pipe production method as recited in the aforementioned Item 2 or 3, wherein the rubbing member comprises at least one element selected from the group consisting of an ultra fine fiber woven fabric with a fiber diameter of 50 to 1 μm and an ultra fine fiber non-woven fabric with a fiber diameter of 50 to 1 μm.

[10] The aluminum pipe production method as recited in the aforementioned Item 9, further comprising a step for preparing a rubbing tape in which the rubbing member is formed into a band shape or a tape shape, wherein the rubbing tape rubs the surface of the aluminum raw pipe while driving the rubbing tape in a direction perpendicular to a longitudinal direction of the aluminum raw pipe.

[11] The aluminum pipe production method as recited in the aforementioned Item 10, wherein the driving speed of the rubbing tape is set to 5 to 25 cm/min., and a contact pressure of the rubbing tape against the aluminum raw pipe is set to 5 to 30 g/cm$^2$.

[ 12] The aluminum pipe production method as recited in any one of the aforementioned Items 1 to 11, wherein at the slug removing step, aluminum slugs which will have an area of 0.03 mm$^2$ after the drawing step are removed.

[13] The aluminum pipe production method as recited in any one of the aforementioned Items 1 to 12, wherein before executing the slug removing step, a cutting step for cutting the aluminum raw pipe into a predetermined length is executed.

[14] An aluminum pipe obtained by the method as recited in any one of the aforementioned Items 1 to 13.

[ 15] An aluminum pipe obtained by the method as recited in any one of the aforementioned Items 1 to 13, wherein an area of the aluminum slug adhering to the surface of the aluminum pipe is regulated to 0.03 mm$^2$ or less.

[16] A photosensitive drum substrate using the aluminum pipe as recited in the aforementioned Item 14 or 15.

[17] A photosensitive drum, characterized in that a photosensitive layer is formed on a surface of the photosensitive drum substrate as recited in the aforementioned Item 16.

[18] A photosensitive drum production method, comprising:

a step for obtaining an aluminum pipe by the method as recited in any one of the aforementioned Items 1 to 13; and a step for forming a photosensitive layer on a surface of the aluminum pipe.

[19] An aluminum slug removing method for removing aluminum slugs from a surface of an aluminum raw pipe obtained by an extrusion step, characterized in that before subjecting the aluminum raw pipe to a drawing step, the aluminum slugs adhering to the surface of the aluminum raw pipe is removed by rubbing the surface.

[20] An aluminum slug removing device for removing aluminum slugs adhering a surface of an aluminum raw pipe obtained by an extrusion step before subjecting to the aluminum raw pipe to a drawing step, characterized in that the aluminum slugs are rubbed off by rubbing the surface of the aluminum raw pipe with a soft rubbing member.

[21] An aluminum slug removing rubbing member for rubbing off aluminum slugs adhering to a surface of an aluminum raw pipe obtained by an extrusion step before subjecting the aluminum raw pipe to a drawing step, characterized in that the rubbing member comprises at least one element selected from the group consisting of a brush, a sponge, an ultra fine fiber fabric, and a ultra fine fiber non-woven fabric.

[22] A drawing aluminum raw pipe to be subjected to a drawing step, characterized in that the aluminum raw pipe is obtained by an extrusion step and aluminum slugs adhering to a surface of the aluminum raw pipe is removed by being rubbed.

EFFECTS OF THE INVENTION

According to the invention as recited in the aforementioned Item [1], in the slug removing step, aluminum slugs which will become defect protrusions after a drawing step can be rubbed off, which make it possible to produce a high quality aluminum pipe with harmless defect protrusions. Furthermore, since the aluminum slugs adhering to the surface of the aluminum raw pipe are rubbed off, it is not required to execute conventional inefficient processing such as, e.g., processing for modifying the entire surface of the aluminum raw pipe by cutting, polishing, etc., resulting in efficient productivity and reduced production cost. Furthermore, as compared with a method for removing a certain thickness of an entire surface area of an aluminum raw pipe, in the invention, aluminum slugs are removed. Therefore, the method of the invention causes no diameter change and the dimensional control can be performed easily, resulting in further enhanced quality.

According to the invention as recited in the aforementioned Items [2] to [11], aluminum slugs adhering to the surface of the aluminum raw pipe can be removed more assuredly.

According to the invention as recited in the aforementioned Item [12], it is possible to prevent generation of harmful defect protrusion more assuredly.

According to the invention as recited in the aforementioned Item [13], a desired aluminum pipe can be produced more efficiently.

According to the aluminum pipe of the invention as recited in the aforementioned Items [14] and [15], in the same manner as mentioned above, the aluminum pipe can be produced efficiently and easily, resulting in reduced production cost and high quality.

According to the photosensitive drum substrate of the invention as recited in the aforementioned Item [16], in the same manner as mentioned above, the photosensitive drum substrate can be produced efficiently and easily, resulting in reduced production cost and high quality.

According to the photosensitive drum of the invention as recited in the aforementioned Item [17], in the same manner as mentioned above, the photosensitive drum can be produced efficiently and easily, resulting in reduced production cost and high quality.

According to the production method of the invention as recited in the aforementioned Item [ 18], in the same manner as mentioned above, a high quality photosensitive drum can be produced efficiently and easily and the production cost can be reduced.

According to the invention as recited in the aforementioned Items [19] and [20], in the same manner as mentioned above, a high quality aluminum pipe can be produced efficiently and easily and the production cost can be reduced.

Using the rubbing member according to the invention as recited in the aforementioned Item [21] enables efficient production of high quality aluminum pipe and cost reduction in the same manner as mentioned above.

Using the aluminum raw pipe according to the invention as recited in the aforementioned Item [ 22 ] enables efficient production of high quality aluminum pipe and cost reduction in the same manner as mentioned above.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF DRAWINGS

The preferred embodiments of the present invention are shown by way of example, and not limitation, in the accompanying figures, in which.

BEST MODE FOR CARRYING OUT THE INVENTION

In the following paragraphs, some preferred embodiments of the invention will be described by way of example and not limitation. It should be understood based on this disclosure that various other modifications can be made by those in the art based on these illustrated embodiments.

Figure 1:
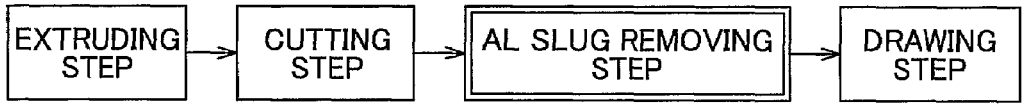
FIG. 1 shows steps of an aluminum pipe production method according to an embodiment of the present invention.

FIG. 1 shows production steps of an aluminum pipe for a photosensitive drum substrate according to an embodiment of the present invention. As shown in FIG. 1, the production method of this embodiment includes an extruding step, a cutting step, a slug removing step and a drawing step as fundamental structural elements.

At the extruding step, an aluminum (including its aluminum alloy) extruding material (ingot) is subjected to a hot extrusion to thereby form a cylindrical long aluminum raw pipe with a diameter of about 10 to 300 mm.

As such aluminum extruding material, from a viewpoint of corrosion resistance, workability, and mechanical strength, JIS 1000, 3000, 5000 or 6000 series aluminum alloy can be preferably used.

On the surface of the aluminum raw pipe obtained through an extrusion step, there are numerous aluminum slugs adhering to the surface.

The aluminum raw pipe is cut into a predetermined length at the cutting step. The length is not specifically limited, but the preferable length is about 200 to 6,000 mm.

Thereafter, at the slug removing step, the aluminum slugs adhering to the surface of the aluminum raw pipe having a predetermined length are removed.

Figure 2:
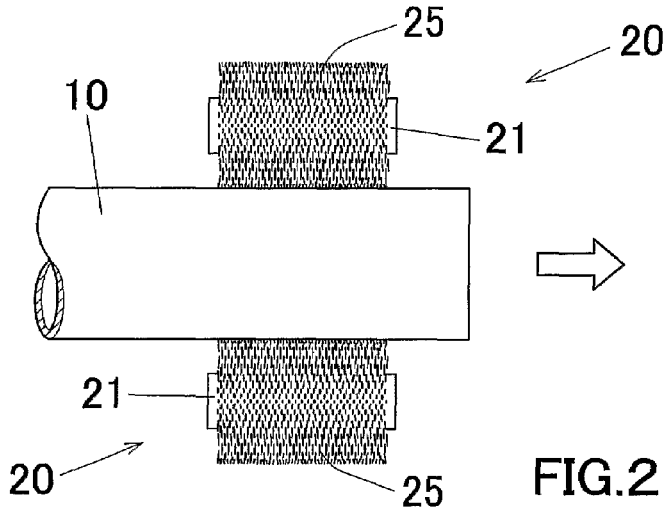
FIG. 2 is a schematic side view showing an aluminum slug removing device applied to a production method of an embodiment of the present invention.
Figure 3:
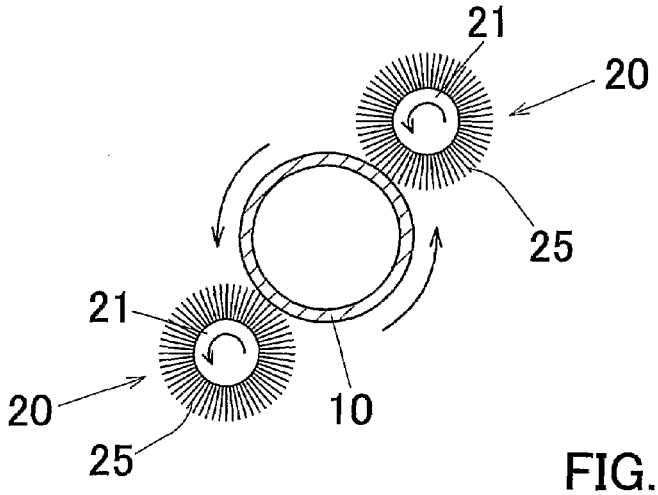
FIG. 3 is a schematic front cross-sectional view showing an aluminum slug removing device of the embodiment of the present invention.

At this slug removing step, a slug removing device as shown, for example, in FIGS. 2 and 3 are used to remove the aluminum slugs. This device is equipped with a delivering mechanism for delivering the cut aluminum raw pipe 10 in its longitudinal direction, and two rubbing rollers 20 and 20 positioned around the external peripheral surface of the aluminum raw pipe 10 to be delivered.

This rubbing roller 20 is provided with a spindle 21 and a brush 25 attached to the external peripheral surface of the spindle 21.

In this embodiment, the brush 25 with bristles of nylon fibers, polyester fibers, polyurethane fibers, or cottons can be preferably used. Among other things, a brush with nylon bristles (e.g., "Multi-nylon (trademark)" provided by Showa Kogyo Kabushiki Kaisha) can be preferably used.

It is preferable that the bristle diameter is 50 to 1 μm, more preferably 40 μm or less, still more preferably 30 μm less. In cases where the bristle diameter is too large, when the brush 25 rubs the surface of the aluminum raw pipe 10, aluminum slugs are crushed and strongly adhere to the surface of the aluminum raw pipe 10, which in turn makes it difficult to assuredly rub off the slugs. To the contrary, in cases where the bristle diameter is too small, the bristle rigidity becomes insufficient, resulting in a failure of rubbing off the aluminum slugs.

Too long or too short bristle length also makes it difficult to assuredly rub off the aluminum slugs. Concretely, it is preferable that the bristle length is 20 to 100 mm, more preferably 30 to 80 mm, still more preferably 35 to 70 mm.

The brush 25 of the aforementioned structure is wound around the external peripheral surface of the spindle 21 with the bristle tip facing outwardly to thereby form a rubbing roller 20.

The aforementioned two rubbing rollers 20 and 20 are arranged at the opposite sides of the aluminum raw pipe 10 with their axes parallel to the axis of the aluminum raw pipe 10.

The rubbing roller 20 is configured so as to rotate about the spindle 21 and come in contact with and come free from the aluminum raw pipe 10. When the rubbing roller 20 is rotated in contact with the aluminum raw pipe 10, the bristles of the rubbing roller 20 rub the surface of the aluminum raw pipe 20.

Furthermore, the rubbing roller 20 is configured so as to move relative to the aluminum raw pipe 10 in the peripheral direction of the pipe 10 along the external peripheral surface of the raw pipe 10 when the aluminum raw pipe 10 rotates about its axis. Accordingly, for example, the bristles of the rubbing roller 20 can rub the entire region of the external peripheral surface of the aluminum raw pipe 10 by moving the rubbing rollers 20 and 20 relatively around the aluminum raw pipe 10 in the circumferential direction of the pipe while rotating the rubbing rollers 20 and delivering the aluminum raw pipe 10 in the longitudinal direction thereof.

The aluminum raw pipe 10 and the rubbing roller 20 can be rotated in any direction respectively, and the rotation direction of the aluminum raw pipe 10 with respect to the rubbing roller 20 can be the same direction as the rotation direction of the rubbing roller 20 or the opposite direction.

By rubbing the surface of the aluminum raw pip 10 with the rubbing rollers 20 and 20, desired aluminum slugs which adhered to the surface of the aluminum raw pipe 10 at the extruding step can be rubbed off assuredly.

In this embodiment, the external diameter of the rubbing roller 20 is preferably adjusted to 50 to 240 mm, more preferably 90 to 200 mm. The rotation speed of the rubbing roller 20 is preferably adjusted to 1,000 to 3,000 rpm, more preferably 1,500 to 2,500 rpm. The bristle contact length of the rubbing roller 20 which comes into contact with the surface of the aluminum raw pipe 10 is preferably adjusted to 1 to 5 mm, more preferably 2 to 3 mm. By adjusting the aforementioned values as mentioned above, the aluminum slug adhering to the surface of the aluminum raw pipe 10 can be assuredly rubbed off.

As a rubbing member, although a brush is used in this embodiment, the present invention is not limited to it. For example, any soft rubbing member made of, e.g., ultra fine fiber woven fabric (wiping cloth), polyurethane sponge, or ultra fine fiber non-woven fabric (wiper) can be used.

As the wiping cloth, it is preferable to use a wiping cloth comprising a core material of nylon and a peripheral material of polyester (e.g., "Berima" (trademark) provided by Kanebo Gohsen, Ltd.)

As the wiper, it is preferable to use a non-woven fabric made of cupra fibers (e.g., "Benrize" (trademark) or "Benkotto" (trademark) provided by Asahi Kasei Fibers Corporation).

In the woven fabric and non-woven fabric used as the rubbing member, in the same manner as in the brush 25, it is preferable that the fiber diameter is 50 to 1 μm, more preferably 40 μm or less, still more preferably 30 μm or less. Since a fabric with short fibers may drop to adversely affect on the surface of the aluminum pipe, a fabric with longer fibers is preferably used.

In cases where the aforementioned woven fabric or non-woven fabric is used as the rubbing member, a rubbing tape obtained by forming the fabric into a tape-shape or a belt-shape can be preferably used.

Figure 5:
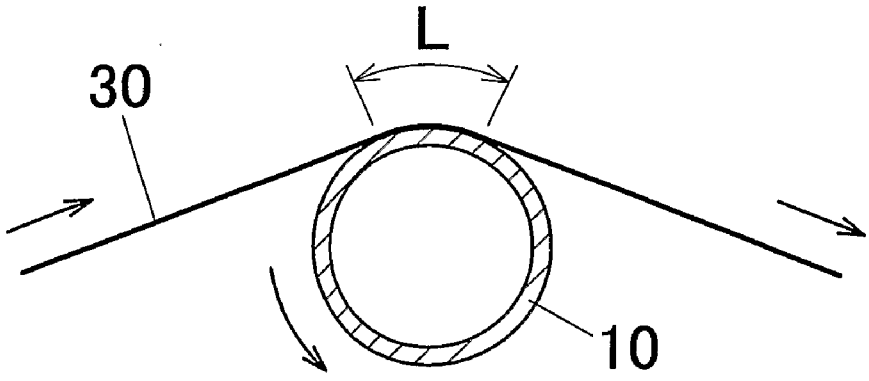
FIG. 5 is a schematic front cross-sectional view showing an aluminum slug removing device of a modified embodiment of the present invention.

For example, as shown in FIG. 5, the rubbing tape 30 can be delivered in a direction perpendicular to the longitudinal direction (delivering direction) of the aluminum raw pipe 10 so that the tape can rub the surface of the aluminum raw pipe 10.

It is preferable to use a rubbing tape 30 having a width of 100 to 50 mm, preferably 150 to 450 mm. If the width is too small, it is difficult to rub the entire area of the external surface of the aluminum raw pipe 10, which in turn makes it difficult to assuredly remove the aluminum slugs on the aluminum raw pipe 10. On the other hand, if the tape width is too wide, it becomes difficult to bring the entire widthwise area of the tap 30 into contact with the surface of the aluminum raw pipe 10 with even pressure, which in turn also makes it difficult to assuredly remove the aluminum slugs on the aluminum raw pipe 10.

Furthermore, the longitudinal contact length L of the rubbing tape 30 in contact with the aluminum raw material 10, or the contact length L of the aluminum raw pipe 10 in the circumferential direction in contact with the rubbing tap 30, is preferably 3 to 30 mm, more preferably 5 to 25 mm. If this length L is too short or too long, it becomes difficult to control the contact pressure of the rubbing tape 30 against the aluminum raw pipe 10, which may make it difficult to remove aluminum slugs efficiently.

The delivering speed of the rubbing tape 30 is preferably adjusted to 3 to 30 cm/min., more preferably 5 to 20 cm/min. If the speed does not fall within the range, it may become difficult to assuredly remove aluminum slugs.

The contact pressure of the rubbing tape 30 against the aluminum raw pipe 10 is preferably adjusted to 5 to 30 g/cm$^2$, more preferably 7 to 18 g/cm$^2$. If the contact pressure is too small, aluminum slugs cannot be removed assuredly. To the contrary, if the contact pressure is too large, the surface of the aluminum raw pipe 10 may be damaged due to the excessive pressure.

The rotation direction of the aluminum raw pipe 10 can be any direction regardless of the delivering direction of the rubbing tap 30.

As shown in FIG. 1, after completion of the slug removing step, the aluminum raw pipe 10 is subjected to a cold drawing at the drawing step, to thereby obtain an aluminum pipe for a photosensitive drum substrate.

The drawing process is performed at a single step or two steps, and the area reduction rate is adjusted to 10% or more. The drawing speed is not specifically limited, but is preferably adjusted to 5 to 50 m/min.

The aluminum pipe for a photosensitive drum substrate obtained as mentioned above has a surface from which aluminum slugs (aluminum slug extended pieces) constituting defect protrusions were removed.

In detail, aluminum slugs which adhered on the aluminum raw pipe at the time of the extrusion process are extended during the drawing process into thin lepidic aluminum slug extended pieces. In this embodiment, however, aluminum slugs are removed at the aluminum slug removing step such that no extruded slug having a large area remain. Concretely, relatively large aluminum slugs are removed at the aluminum slug removing step such that only extended slugs having an area (converted into ellipse similarity area) of 0.03 mm$^2$ or less, preferably 0.025 mm$^2$ or less, more preferably 0.02 mm$^2$ or less remain. In other words, relatively large aluminum slugs are removed at the aluminum slug removing step such that extended slugs having an area (converted into ellipse similarity area) of 0.03 mm$^2$ or above, preferably 0.025 mm$^2$ or above, more preferably 0.02 mm$^2$ or above do not remain.

That is to say, relatively large aluminum slugs are removed at the slug removing step such that only aluminum slug extended pieces with a length (major axis) of less than 200 μm and/or only aluminum slug extended pieces with a width (minor axis) of less than 100 μm, preferably only aluminum slug extended pieces with a length (major axis) of less than 180 μm and/or only aluminum slug extended pieces with a width (minor axis) of less than 80 μm, remains among aluminum slug extended pieces. In other words, relatively large aluminum slugs are removed at the slug removing step so that aluminum slug extended pieces with a length of 200 μm or more and/or a width of 100 μm or more, more preferably a length of 180 μm or more and/or a width of 80 μm or more, do not exist.

As will be apparent from the above, in this embodiment, since aluminum slug extended pieces with a small area (size) remain on the surface of the aluminum pipe, even if the extended pieces are raised due to external influences, they do not act as large protrusions causing defects. Accordingly, when a photosensitive layer is formed on the surface of the aluminum pipe, no image defect due to leaks, etc. occurs, resulting in high quality. That is, the obtained aluminum pipe for a photosensitive drum substrate is to be cut into a predetermined length, and if needed, subjected to a predetermined end face finishing process, to produce a photosensitive drum substrate of high quality.

In this embodiment, when aluminum slugs are rubbed off, some of the aluminum slugs thermally adhering to the surface of the aluminum raw pipe 10 may remain. However, such thermally adhering portion securely adheres to the surface of the raw pipe 10 and the size is very small. Therefore, the remained thermally adhering portion would never rise at the subsequent steps and therefore they do not act as defect protrusions.

According to the production method of this embodiment, before the drawing step, aluminum slugs adhering to the surface of the aluminum raw pipe 10 are merely dropped off (rubbed off) with a rubbing rollers 20. Therefore, like in a conventional method, it is not required to execute an inefficient process, e.g., process for modifying the entire surface by cutting, polishing, etc., after a drawing process. Thus, the production can be performed efficiently and simply, thereby enabling reduction of production cost.

Furthermore, according to the embodiment, since aluminum slugs on the surface of the aluminum raw pipe are merely dropped off with rubbing rollers 20, it is not required to execute surface removing processing for removing the surface of the aluminum raw pipe evenly as required in a conventional method. Thus, no diameter change occurs, the dimensional control can be performed easily, and high quality can be attained. Furthermore, in the embodiment, since the entire surface portion is not removed, it can be possible to assuredly prevent defects that aluminum slugs generated during the surface removing processing will re-adhere to the surface of the aluminum raw pipe to cause defect protrusions, resulting in high quality.

EXAMPLE

Hereinafter, examples related to the invention will be explained.

Example 1

An aluminum raw pipe with an external diameter of 32 mm formed by a hot extrusion was cut into a length of 2,500 mm. Thereafter, at a slug removing step, aluminum slugs adhering to the surface of the aluminum raw pipe were removed.

Figure 4:
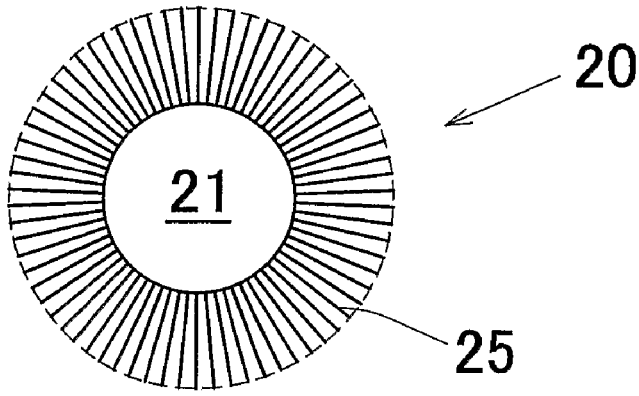
FIG. 4 is a front cross-sectional view showing a rubbing roller applied to a production method of the embodiment of the present invention.

At this slug removing step, in the same manner as shown in FIG. 4, a rubbing roller 20 similar to the rubbing roller employed in the aforementioned embodiment in which a brush 25 was wounded on the external peripheral surface of the spindle 21 was used.

As the brush 25, a brush having bristles made by Showa Kogyo Kabushiki Kaisha "Multi nylon" (trademark) with a bristle length of 50 mm, a bristle diameter of 25 μm was used.

The spindle 21 was 30 mm in external diameter, and the entire diameter of the roller 20 was 130 mm.

Two rubbing rollers 20 mentioned above were prepared. Using a device similar to the device shown in FIGS. 2 and 3, aluminum slugs adhering to the external circumferential surface of the aluminum raw pipe 10 were dropped off with the brush 25 to thereby be removed in a state in which the rotating rubbing rollers 20 were brought into contact with the aluminum raw pipe 10 delivering in its axial direction and relatively moved in the circumferential direction around the aluminum raw pipe 10 in accordance with the rotation of the aluminum raw pipe 10. The rotation speed of the rubbing roller 20 was set to 2,000 rpm and the bristle contact length of the brush 25 was set to 2 to 3 mm.

The aluminum raw pipe from which aluminum slugs were removed was subjected to a cold drawing process at the drawing step to produce an aluminum pipe for a photosensitive drum substrate. This drawing process was executed at two stages, and the area reduction rate was adjusted to 64%. The drawing speed was adjusted to 22 to 25 m/min.

Figure 6:
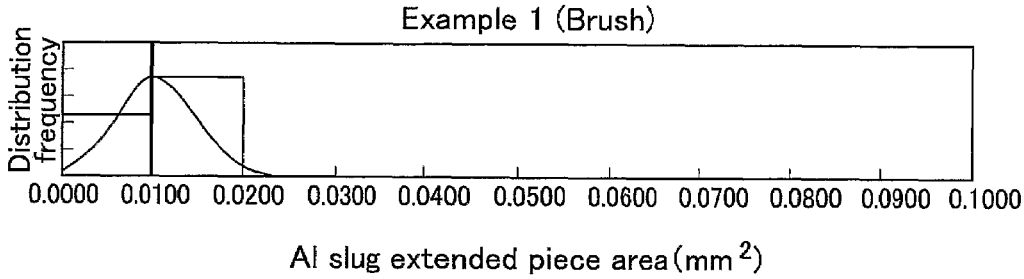
FIG. 6 is a graph showing the relationship between an area of an aluminum slug extended piece of the aluminum pipe of Example 1 according to the invention and the distribution frequency thereof.

The surface of the aluminum pipe obtained as mentioned above was observed with a light microscope. An area of an aluminum slug extended piece (Al slug extended piece) formed by being extended was calculated as an ellipse similarity area. The area (size) of the extended piece and the distribution frequency (the number of pieces) per each area were measured. The results are shown by the graph in FIG. 6. In this graph, the line graph was created based on the actual measurements, and the bar graph was created based on the distribution frequency every 0.01 $mm^2$. In FIG. 6, the vertical heavy line denotes an average of the aluminum slug extended area (same as in the graphs shown in FIGS. 7 to 10).

Example 2

At the slug removing step, as shown in FIG. 5, using a rubbing tape of a wiping cloth ("Berima" (trademark) provided by Kanebo Gohsen, Ltd.), aluminum slugs were removed.

The width of the rubbing tape was 300 mm, the delivering speed of the rubbing tape was 10 cm/min., the contact length of the rubbing tape with respect to the raw pipe was 10 mm, the contact pressure was 10 $g/cm^2$.

Figure 7:
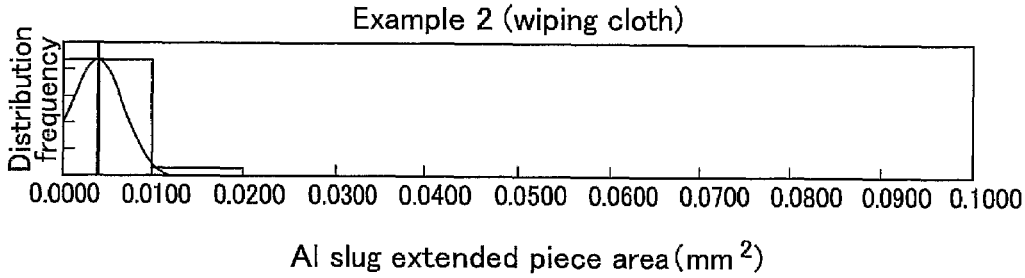
FIG. 7 is a graph showing the relationship between an area of an aluminum slug extended piece of the aluminum pipe of Example 2 according to the invention and the distribution frequency thereof.
Figure 8:
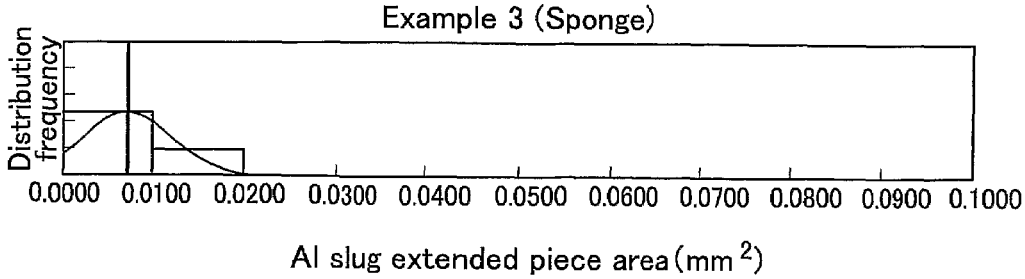
FIG. 8 is a graph showing the relationship between an area of an aluminum slug extended piece of the aluminum pipe of Example 3 according to the invention and the distribution frequency thereof.
Figure 9:
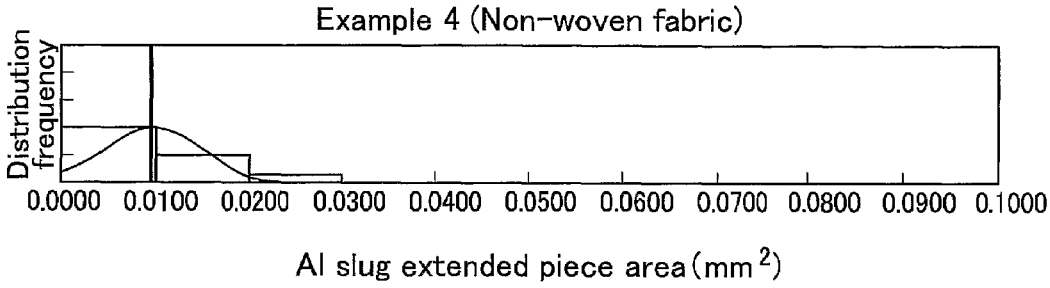
FIG. 9 is a graph showing the relationship between an area of an aluminum slug extended piece of the aluminum pipe of Example 4 according to the invention and the distribution frequency thereof.
Figure 10:
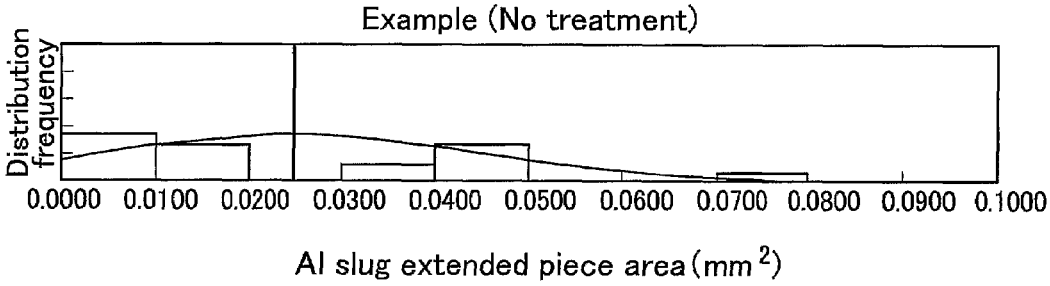
FIG. 10 is a graph showing the relationship between an area of an aluminum slug extended piece of the aluminum pipe of Comparative Example falling outside of the scope of the invention and the distribution frequency thereof.
Figure 11A:
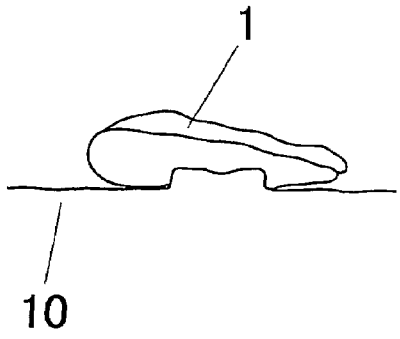
FIGS. 11A to 11C are schematic views showing generation mechanism of defect protrusions in an aluminum pipe for a photosensitive drum substrate.
Figure 11B:
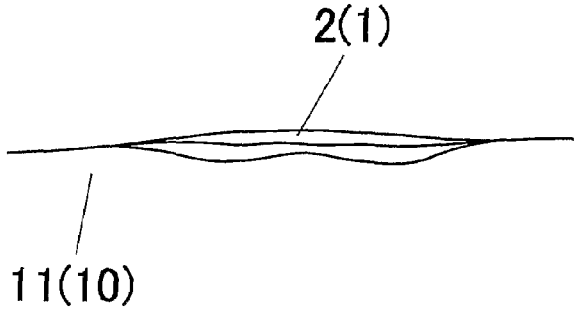
Figure 11C:
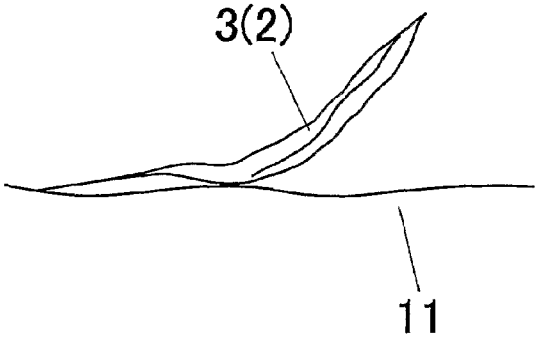

Other than the above, in the same manner as in the aforementioned Example 1, an aluminum pipe for a photosensitive drum substrate was produced. Then, the area of aluminum slug extended piece and the distribution frequency were measured (FIG. 7).

Example 3

An aluminum pipe for a photosensitive drum substrate was produced, and the area of aluminum slug extended piece and the distribution frequency were measured (FIG. 8) in the same manner as in Example 1, except that a rubbing roller in which 50 mm thick polyurethane sponge was wounded around the external periphery of a spindle of 30 mm external diameter was used.

Example 4

An aluminum pipe for a photosensitive drum substrate was produced, and the area of aluminum slug extended piece and the distribution frequency were measured (FIG. 9) in the same manner as in Example 2, except that a rubbing tape made of a cupra fiber non-woven fabric ("Benkotto" (trademark) provided by Asahi Kasei Fibers Corporation) was used.

Comparative Example

An aluminum pipe for a photosensitive drum substrate was produced by subjecting an aluminum raw pipe obtained by an extrusion process to a drawing process without executing any surface treatment. And, the area of aluminum slug extended piece and the distribution frequency were measured (FIG. 10) in the same manner as mentioned above.

<Evaluation>

Regarding the aforementioned Examples and Comparative Example, the maximum area, the minimum area, the average area, and the standard deviation of the aluminum slug extended pieces were measured. The results are shown in the following Table 1.

TABLE 1

| | Example 1 (Brush) | Example 2 (Woven fabric) | Example 3 (Sponge) | Example 4 (Non-woven fabric) | Comparative Example (without removing slugs) |
|---|---|---|---|---|---|
| Minimum ($mm^2$) | 0.005 | 0.001 | 0.003 | 0.002 | 0.004 |
| Maximum ($mm^2$) | 0.020 | 0.010 | 0.019 | 0.021 | 0.071 |
| Average ($mm^2$) | 0.0106 | 0.0038 | 0.0071 | 0.0094 | 0.0248 |
| Standard deviation ($mm^2$) | 0.0044 | 0.0029 | 0.0050 | 0.0055 | 0.0204 |

As will be apparent from the above Table 1 and each graph, in the Comparative Example falling outside of the scope of the invention, the aluminum slug extended pieces adhering to the surface include small pieces to large pieces. Accordingly, it is considered that if the large pieces among these pieces are raised due to external forces, they act as defect protrusions, causing defects such as image defects.

On the other hand, in the aluminum pipes according to Examples related to the invention, no large aluminum slug extended piece remained, and only small aluminum slug extended pieces remained. These small aluminum slug extended pieces adhered to the surface of the aluminum pipe. securely and did not cause defects such as rising. Even if such small aluminum slug extended pieces are raised, they do not act as harmful defect protrusions since they are sufficiently small. This effectively prevents defects such as image defects.

Among aluminum slug extended pieces on the surface of the aluminum pipe, larger pieces act as harmful defect protrusions, and smaller pieces does not act as harmful defect protrusions as already explained.

INDUSTRIAL APPLICABILITY

The aluminum pipe production method of this invention can be preferably used in producing an aluminum pipe to be used as a photosensitive drum for copying machines or electrophotographic devices such as laser beam printers or facsimile devices.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

The invention claimed is:

1. An aluminum pipe production method comprising:

obtaining an aluminum raw pipe by an extrusion step;

executing a drawing step process of the aluminum raw pipe; and before executing the drawing step, removing aluminum slugs adhering to a surface of the aluminum raw pipe by rubbing off the aluminum slugs, wherein the aluminum slugs are removed by rubbing a soft rubbing member against a surface of the aluminum raw pipe, and wherein the rubbing member is a brush with a bristle diameter of 50 to 1 μm.

2. The aluminum pipe production method as recited in claim 1, wherein a bristle length of the brush is adjusted to 20 to 100 mm.

3. The aluminum pipe production method as recited in claim 1, further comprising preparing a rubbing roller in which the rubbing member is wound around a central axle, wherein an external surface of the rubbing roller rubs the surface of the aluminum raw pipe while rotating the rubbing roller.

4. The aluminum pipe production method as recited in claim 3, wherein the rubbing roller is set to 50 to 240 mm in roller external diameter, and wherein a rotation speed of the rubbing roller is set to 1,000 to 3,000 rpm.

5. The aluminum pipe production method as recited in claim 3, wherein at the time of removing the aluminum slugs with the rubbing roller, the rotating rubbing roller is moved relative to the aluminum raw pipe along an external periphery of the aluminum raw pipe while rubbing the aluminum raw pipe with the rotating rubbing roller.

6. The aluminum pipe production method as recited in claim 1, wherein at the slug removing step, aluminum slugs which will have an area of 0.03 $mm^2$ after the drawing step are removed.

7. The aluminum pipe production method of claim 1, further comprising forming a photosensitive layer on a surface of the aluminum pipe to produce a photosensitive drum.

8. An aluminum pipe production method comprising:

obtaining an aluminum raw pipe by an extrusion step;

executing a drawing step process of the aluminum raw pipe;

before executing the drawing step, removing aluminum slugs adhering to a surface of the aluminum raw pipe by rubbing off the aluminum slugs, wherein the aluminum slugs are removed by rubbing a soft rubbing member against a surface of the aluminum raw pipe; and preparing a rubbing roller in which the rubbing member is wound around a central axle, wherein an external surface of the rubbing roller rubs the surface of the aluminum raw pipe while rotating the rubbing roller.

9. The aluminum pipe production method as recited in claim 8, wherein the rubbing member comprises at least one element selected from the group consisting of a brush, a sponge, an ultra fine fiber woven fabric, and an ultra fine fiber non-woven fabric.

10. The aluminum pipe production method as recited in claim 8 wherein the rubbing roller is set to 50 to 240 mm in roller external diameter, and wherein a rotation speed of the rubbing roller is set to 1,000 to 3,000 rpm.

11. The aluminum pipe production method as recited in claim 10 wherein at the time of removing the aluminum slugs with the rubbing roller, the rotating rubbing roller is moved relative to the aluminum raw pipe along an external periphery of the aluminum raw pipe while rubbing the aluminum raw pipe with the rotating rubbing roller.

12. The aluminum pipe production method as recited in claim 8 wherein at the slug removing step, aluminum slugs which will have an area of 0.03 $mm^2$ after the drawing step are removed.

13. The aluminum pipe production method of claim 8 further comprising forming a photosensitive layer on a surface of the aluminum pipe to produce a photosensitive drum.

14. An aluminum pipe production method comprising:

obtaining an aluminum raw pipe by an extrusion step;

executing a drawing step process of the aluminum raw pipe; and before executing the drawing step, removing aluminum slugs adhering to a surface of the aluminum raw pipe by rubbing off the aluminum slugs, wherein the aluminum slugs are removed by rubbing a soft rubbing member against a surface of the aluminum raw pipe, wherein the rubbing member comprises at least one element selected from the group consisting of an ultra fine fiber woven fabric with a fiber diameter of 50 to 1 μm and an ultra fine fiber non-woven fabric with a fiber diameter of 50 to 1 μm.

15. The aluminum pipe production method as recited in claim 14 further comprising preparing a rubbing tape in which the rubbing member is formed into a band shape or a tape shape, wherein the rubbing tape rubs the surface of the aluminum raw pipe while driving the rubbing tape in a direction perpendicular to a longitudinal direction of the aluminum raw pipe.

16. The aluminum pipe production method as recited in claim 15 wherein the driving speed of the rubbing tape is set to 5 to 25 cm/min., and a contact pressure of the rubbing tape against the aluminum raw pipe is set to 5 to 30 $g/cm^2$.

17. The aluminum pipe production method as recited in claim 14, wherein at the slug removing step, aluminum slugs which will have an area of 0.03 $mm^2$ after the drawing step are removed.

18. The aluminum pipe production method of claim 14, further comprising forming a photosensitive layer on a surface of the aluminum pipe to produce a photosensitive drum.

19. An aluminum pipe production method comprising:

obtaining an aluminum raw pipe by an extrusion step;

executing a drawing process of the aluminum raw pipe;

before executing the drawing step, removing aluminum slugs adhering to a surface of the aluminum raw pipe by rubbing off the aluminum slugs, wherein the aluminum slugs are removed by rubbing a soft rubbing member against a surface of the aluminum raw pipe; and preparing a rubbing tape in which the rubbing member is formed into a band shape or a tape shape, wherein the rubbing tape rubs the surface of the aluminum raw pipe while driving the rubbing tape in a direction perpendicular to a longitudinal direction of the aluminum raw pipe.

20. The aluminum pipe production method as recited in claim 19, wherein the driving speed of the rubbing tape is set to 5 to 25 cm/min., and a contact pressure of the rubbing tape against the aluminum raw pipe is set to 5 to 30 g/cm$^2$.

21. The aluminum pipe production method as recited in claim 19 wherein at the slug removing step, aluminum slugs which will have an area of 0.03 mm$^2$ after the drawing step are removed.

22. The aluminum pipe production method of claim 19 further comprising forming a photosensitive layer on a surface of the aluminum pipe to produce a photosensitive drum.

23. An aluminum pipe production method comprising:

obtaining an aluminum raw pipe by an extrusion step;

executing a drawing process of the aluminum raw pipe; and before executing the drawing step, removing aluminum slugs adhering to a surface of the aluminum raw pipe by rubbing off the aluminum slugs, wherein at the slug removing step, aluminum slugs which will have an area of 0.03 mm$^2$ after the drawing step are removed.

24. The aluminum pipe production method as recited in claim 23 wherein the aluminum slugs are removed by rubbing a soft rubbing member against a surface of the aluminum raw pipe.

* * * * *